US007650103B2

(12) United States Patent
Isomura

(10) Patent No.: US 7,650,103 B2
(45) Date of Patent: Jan. 19, 2010

(54) DEVELOPER SUPPLY CONTAINER

(75) Inventor: Tetsuo Isomura, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 330 days.

(21) Appl. No.: 10/576,691

(22) PCT Filed: Jun. 10, 2005

(86) PCT No.: PCT/JP2005/011086

§ 371 (c)(1),
(2), (4) Date: Feb. 7, 2007

(87) PCT Pub. No.: WO2005/121907

PCT Pub. Date: Dec. 22, 2005

(65) Prior Publication Data

US 2007/0223972 A1 Sep. 27, 2007

(30) Foreign Application Priority Data

Jun. 10, 2004 (JP) ..... 2004-172668

(51) Int. Cl.
*G03G 15/08* (2006.01)

(52) U.S. Cl. ..... 399/262; 399/258

(58) Field of Classification Search ..... 399/222, 399/252, 258, 261, 262
See application file for complete search history.

(56) References Cited

U.S. PATENT DOCUMENTS

| | | | | |
|---|---|---|---|---|
| 5,426,492 | A | 6/1995 | Diehl | 355/260 |
| 5,960,246 | A * | 9/1999 | Kasahara et al. | 399/359 |
| 6,201,941 | B1 * | 3/2001 | Kasahara et al. | 399/258 |
| 6,418,290 | B1 | 7/2002 | Isomura et al. | 399/254 |
| 6,704,533 | B2 | 3/2004 | Isomura et al. | 399/254 |
| 6,788,912 | B2 | 9/2004 | Isomura et al. | 399/254 |
| 6,839,533 | B2 | 1/2005 | Ban et al. | 399/260 |
| 6,963,713 | B2 | 11/2005 | Isomura et al. | 399/262 |
| 6,980,754 | B2 | 12/2005 | Isomura et al. | 399/106 |
| 6,987,942 | B2 | 1/2006 | Yoshikawa et al. | 399/258 |
| 2005/0025529 | A1 | 2/2005 | Isomura et al. | 399/262 |

FOREIGN PATENT DOCUMENTS

| | | |
|---|---|---|
| JP | 62-218975 | 9/1987 |

(Continued)

OTHER PUBLICATIONS

English Machine Translation of JP 2000155459 Jun. 6, 2006.*

*Primary Examiner*—David P Porta
*Assistant Examiner*—Milton Gonzalez
(74) *Attorney, Agent, or Firm*—Fitzpatrick, Cella, Harper & Scinto

(57) ABSTRACT

A developer supply container detachably mountable to an image forming apparatus, and includes a container body having a developer containing portion; a discharging opening, provided in the container body; a gas container storing a compressed gas; a plate-like member, disposed at a position between the container body and the gas container, and configured to move toward the discharge opening to discharge the developer in the developer containing portion through the discharge opening; a switch portion, operable from the image forming apparatus, configured and positioned to release the compressed gas from the gas container so that the plate-like member moves toward the discharge opening; and an urging portion configured and positioned to urge the switch portion to stop the release of the compressed gas from the gas container.

2 Claims, 12 Drawing Sheets

FOREIGN PATENT DOCUMENTS

| | | |
|---|---|---|
| JP | 2-69787 | 3/1990 |
| JP | 3-116170 | 5/1991 |
| JP | 2000-155459 | 6/2000 |
| JP | 2002-72469 | 3/2002 |
| JP | 2002-169362 | 6/2002 |
| JP | 2004-94071 | 3/2004 |

* cited by examiner (A)

(B)

DEVELOPER SUPPLY CONTAINER

TECHNICAL FIELD

The present invention relates to a developer supply container which is removably mounted in an image forming apparatus, for example, a copying machine, a printer (for example, laser beam printer, LED printer, etc.), a facsimile machine, a wordprocessor, etc., which forms images with the use of one of the electrophotographic or electrostatic recording methods, in order to supply the image forming apparatus with developer.

BACKGROUND ART

An image forming apparatus, such as a copying machine, forms an electrostatic latent image of an intended image by selectively exposing numerous points on the peripheral surface of a photosensitive drum according to image formation data. Then, the electrostatic latent image is developed with developer into the intended image. Thereafter, the developed image is transferred onto a recording medium.

Thus, an image forming apparatus, such as a copying machine, has to be supplied with developer each time it runs out of developer.

As for the means for supplying an image forming apparatus with developer, it is a common practice to employ a single or plurality of various developer supply containers, which may be roughly grouped into two types: the so-called dumping type that delivers all at once the entirety of the developer therein into the developer receiving container of the main assembly of an image forming apparatus, and the so-called trickling type (or installation type) that is left in the main assembly of an image forming apparatus to gradually deliver the developer therein into the developer receiving portion of the main assembly.

The trickling type developer supply container is structured so that it discharges developer by receiving a rotational driving force from the motor with which an image forming apparatus is provided.

For example, the developer supply container disclosed in Japanese Laid-open Patent Application 2002-072649 is of the so-called bag-in-box type, which is made up of an external box as a protective casing, and a flexible bag as a toner bag placed in the external box. This developer supply container is also provided with a powder pump, to which driving force is given from the main assembly side of the image forming apparatus to convey the developer in the container.

However, a developer supply container, such as the above-described one, in accordance with the prior art is structured so that the mechanism for conveying developer receives the force for driving the mechanism, from the main assembly side of an image forming apparatus. In other words, an image forming apparatus must be provided with the drive train for transmitting the driving force to the mechanism for conveying developer.

Providing an image forming apparatus with a driving mechanism, such as a drive train complicates the image forming apparatus in structure, possibly increasing the image forming apparatus cost and energy consumption.

Further, according to the prior art, the mechanical power source for driving the developing device(s) of an image forming apparatus is also used to drive a developer supply container, limiting thereby the area in which the developer supply container is installable, to the areas which are immediately next to the system for driving the developing device(s); in other words, where a developer supply container is installable in an image forming apparatus is limited. The adjacencies of the developing device(s) are occupied by a photosensitive drum, an exposing apparatus, a cleaner, etc., affording therefore little space for an additional component. This has been one of the essential impediments in increasing a developer supply container in developer capacity or reducing in size the main assembly of an image forming apparatus.

DISCLOSURE OF THE INVENTION

The primary object of the present invention is to provide a developer supply container that does not impose structural restrictions upon an image forming apparatus.

According to an aspect of the present invention, there is provided a developer supply container detachably mountable to an image forming apparatus, said developer supply container comprising a container body for accommodating a developer, said container body being provided with a discharge opening for permitting discharging of the developer; feeding means for feeding the developer in said container body toward said discharge opening; and a driving source for driving said feeding means.

According to another aspect of the present invention, there is provided a developer supply container detachably mountable to an image forming apparatus, said developer supply container comprising a container body for accommodating a developer, said container body being provided with a discharge opening for permitting discharging of the developer; a storing portion for storing compressed gas for feeding the developer in said container toward said discharge opening.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Hereinafter, the preferred embodiments of the present invention will be described with reference to the appended drawings.

Embodiment 1

Next, the first of the preferred embodiments of the present invention will be described.

(Overall Structure)

First, referring to FIG. 1, an electrophotographic copying machine, which is an example of an image forming apparatus in which a developer supply container in accordance with the present invention can be mounted, and which employs one of the electrophotographic image formation methods, will be described regarding its structure.

Figure 1:
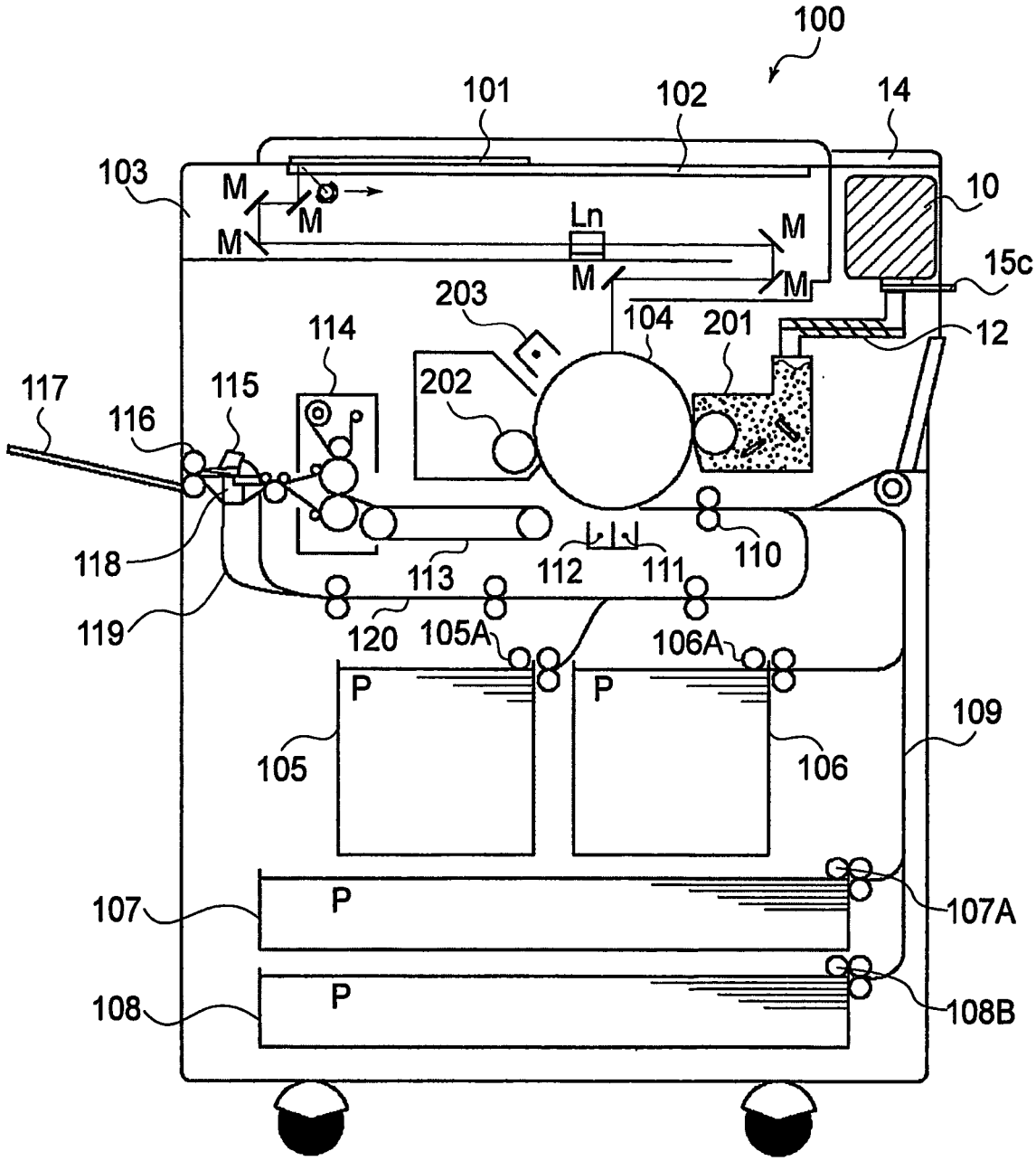
FIG. 1 is a schematic drawing of the electrophotographic copying machine according to a first embodiment of the present invention, showing the general structure thereof.

Referring to FIG. 1, designated by a referential symbol 100 is an electrophotographic copying machine (which hereinafter may be referred to as apparatus main assembly). Designated by a reference numeral 101 is an original, which is placed on an original placement glass platen 102 so that the optical image (image formation data) of the original is formed on the peripheral surface of a drum 104 by a plurality of mirrors M and a lens L of an optical portion 103.

Designated by each of reference numerals 105-108 is a cassette in which a plurality of recording papers P are stored. Among these cassettes 105-108, a cassette which contains the recording papers P optimal based on the information inputted by a user through a control panel (unshown) or the size of the original 101, is selected.

Then, the recording papers P in the selected cassette are fed one by one into the main assembly of the copying machine by the corresponding apparatus for feeding the recording papers P into the main assembly while separating them, that is, one of the apparatuses 105A-108A. Then, each recording paper P is conveyed to a pair of registration rollers 110 through the recording paper conveyance passage 109, and is further conveyed in synchronism with the rotation of the drum 104 and timing with which the peripheral surface of the drum 104 is scanned by the optical portion 103. Incidentally, designated by reference numerals 111 and 112 are a charging device for image transfer, and a charging device for recording paper separation, respectively.

Thereafter, the recording paper P is conveyed through the recording paper conveyance passage 113, to a fixing portion 114, in which the developer T (image formed of developer) on the recording paper P is fixed to the recording paper P by heat and pressure. Thereafter, when the copying machine is in the single-sided copying mode, the recording paper P is discharged into a copy delivery tray 117 by a pair of sheet discharging rollers 116, through a portion 115 for simply discharging, or reversing, the recording paper P.

When the copying machine is in the two-sided copying mode, the flapper 118 of the afore-mentioned portion 115 for simply discharging, or reversing, the recording paper P is controlled so that the recording paper P is conveyed again to the pair of registration rollers 110 through recording paper re-feeding passages 119 and 120. Then, the recording paper P is conveyed again through the path through which the recording paper P was previously conveyed to form an image on the recording paper P. Then, the recording paper P is discharged into the copy delivery tray 117.

When the copying machine is in the multilayer copying mode, the recording paper P is partially discharged through the portion 115 for simply discharging, or reversing, the recording paper P, far enough for the trailing edge of the recording paper P to still remain pinched by the pair of recording paper discharging rollers 116 after passing by the flapper 118. Then, the flapper 118 is controlled, and the pair of recording paper discharging rollers 116 are rotated in reverse, causing the recording paper P to be conveyed back into the apparatus main assembly. Thereafter, the recording paper P is conveyed to the pair of registration rollers 110 through the recording paper re-feeding passages 119 and 120, and then, is discharged into the copy delivery tray 117 after being conveyed through the same path as the path through which the recording paper P is conveyed when in the single-sided copying mode.

In the main apparatus main assembly 100 structured as described above, a developing device 201, a cleaning portion 202, and a primary charging device 203 are disposed in the adjacencies of the peripheral surface of the drum 104. The developing device 201 is for adhering developer T to the peripheral surface of the drum 104 in order to develop the electrostatic latent image, that is, a materialized form of image formation data, into a visible image. A developer supply container 10 for supplying the developing device 201 with developer T is removably mountable in the apparatus main assembly 100.

Figure 2:
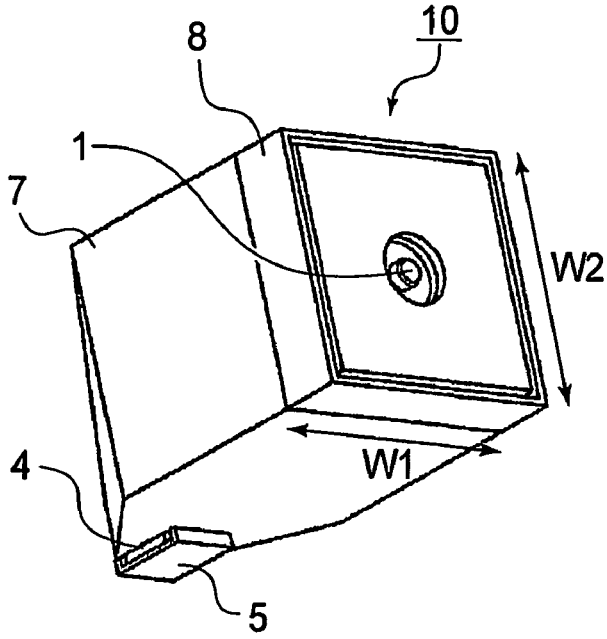
FIG. 2(A) is a perspective view of the developer supply container according to the first embodiment of the present invention, with the shutter 5 remaining attached thereto.
FIG. 2(B) is a perspective view of the same developer supply container as the one shown in FIG. 2(A), after the removal of the container shutter 5.
Figure 2:
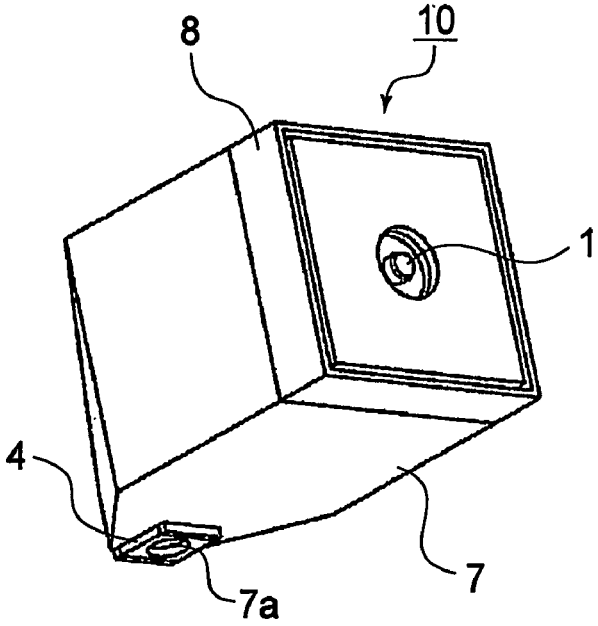
Figure 3:
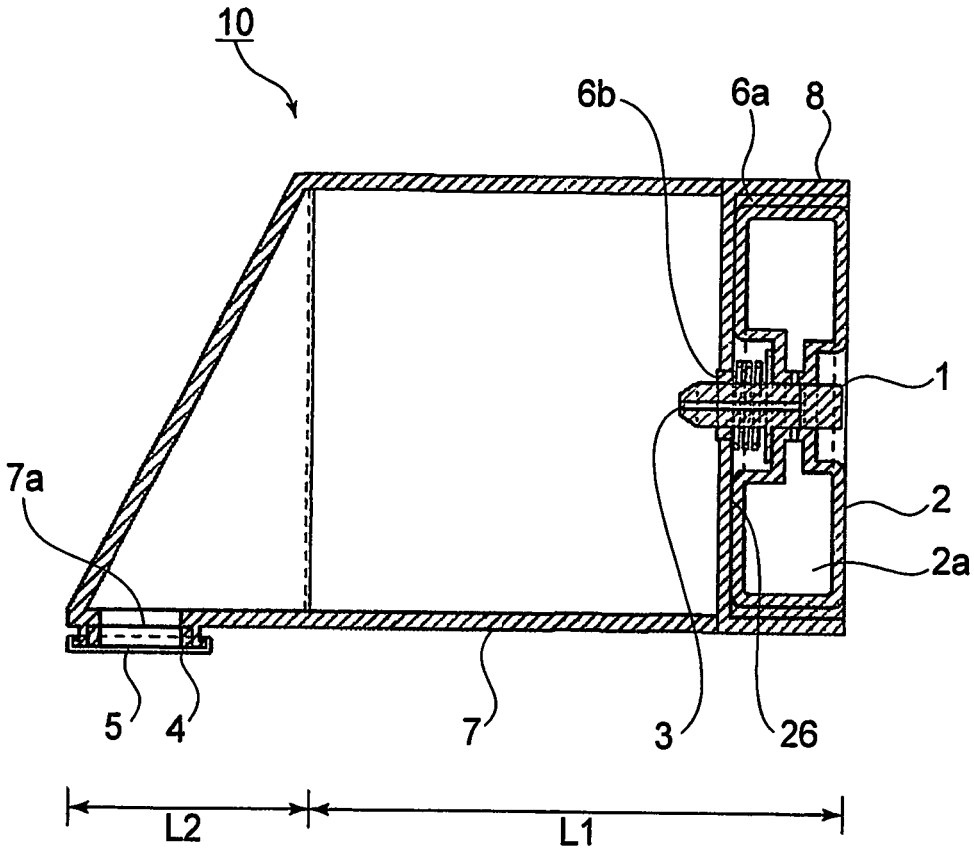
FIG. 3 is a sectional view of the developer supply container according to the first embodiment of the present invention.

Next, referring to FIGS. 2 and 3, the developer supply container 10 will be described. FIG. 2(A) is a perspective view of the developer supply container 10, the container shutter 5 of which is in the closed position, and FIG. 2(B) is a perspective view of the developer supply container 10, the container shutter 5 of which has been removed. FIG. 3 is a sectional view of the developer supply container 10 shown in FIG. 2.

The developer supply container 10 shown in FIG. 2 is of the so-called trickling type, or installation type, which is semi-permanently mounted in the apparatus main assembly 100 to gradually discharge the developer T into the developing device 201, that is, a device to be supplied with the developer T, until the developer T is depleted.

The developer supply container 10 in this embodiment is made up of a container proper 7 in which the developer T is stored, and a driving portion 8 attached to the container proper 7 with use of one of the known means such as ultrasonic welding. The container proper 7 is provided with a developer outlet 7*a* (which hereinafter may be referred to simply as outlet), through which the developer T is discharged from the container proper 7 to supply the image forming apparatus main assembly 100 with the developer T.

The developer supply container 10 is a container for supplying the developing device 201 with the developer T as described above. It is to be set in the apparatus main assembly 100 by a user, and then, as the tab portion 15*c* of the shutter 15 on main assembly side of the image forming apparatus is pushed in by the user, the developer outlet 7*a* of the developer supply container 10 is unsealed to ready the developer supply container 10 to discharge the developer to supply the apparatus main assembly with the developer T.

Next, the configuration of the developer supply container 10 will be described in detail.

Referring to FIG. 2, the container proper 7 is hollow and is shaped like a combination of a rectangular parallelepiped, and a pyramidal portion, one of the surfaces of which is perpendicular to its bottom surface. The driving portion 8 is in the form of a rectangular parallelepiped, and the wall (one of the pair of the largest walls) of the driving portion 8, by which the driving portion 8 is attached to the container proper 7 is roughly identical in size and shape to the wall of the container proper 7, to which the driving portion 8 is attached.

The container proper 7 in this embodiment is roughly 120 mm in width W1 (FIG. 2), roughly 120 mm in width W2 (FIG. 2), roughly 60 mm in the height (L2 in FIG. 3) of the pyramidal portion, and roughly 140 mm in the height (L1 in FIG. 3) of the portion in the form of a rectangular parallelepiped.

Also referring to FIG. 3, the pyramidal portion is provided with the developer outlet 7*a*, which is a part of the downwardly facing wall thereof, whereas the columnar portion with the rectangular cross section is provided with an air storage canister 2 as storage for compressed air. In other words, the developer supply container 10 in this embodiment is structured so that when it is in an image forming apparatus, its wall having the outlet 7*a* faces downward.

By allowing the compressed air in the air storage canister 2 to be discharged into the developer storage portion through a nozzle 3 as an air passage while the outlet 7*a* is open, the developer T in the container proper 7 is conveyed toward the outlet 7*a*, and then, is discharged from the outlet 7*a* to supply the apparatus main assembly with the developer T. The opening of the outlet 7*a* is circular, and is 10 mm in diameter.

Incidentally, the measurements of the developer supply container 10 do not need to be limited to the values given above, as long as the configuration of the developer supply container 10 agrees with the gist of the present invention.

(Air Storage Canister)

Referring to FIG. 3, the air storage canister 2 is disposed in the driving portion 8 of the developer supply container 10. The air storage canister 2 has an air storage portion 2*a* which is to be filled with compressed air as a power source.

Further, the developer supply container 10 is provided with a switch portion 1 as a triggering portion for releasing the compressed gas as necessary, and a nozzle portion 3 as a gas conveying means. The switch portion 1 and nozzle portion 3 are integrally molded of resin.

Incidentally, the switch portion 1 and nozzle portion 3 may be separate, as long as they are structured so that they can be moved together.

The switch portion 1 is kept pressed by a pressing means 26 in the direction (rightward in FIG. 3) to prevent the nozzle portion 3 from being connected to the air storage portion 2*a*, unless the switch portion 1 is pressed by the image forming apparatus. More specifically, unless the switch portion 1 is pressed by the image forming apparatus, the passage between the nozzle portion 3 and air storage portion 2*a* is kept blocked to prevent the air in the air storage portion 2*a* from discharging into the container proper 7 through the nozzle portion 3.

On the other hand, as the switch portion 1 is pressed (leftward in FIG. 3) by the image forming apparatus while the outlet 7*a* of the developer supply container 10 is open, the nozzle portion 3 becomes connected to the air storage portion 2*a*, allowing thereby the compressed air in the air storage portion 2*a* to discharge into the nozzle portion 3, and then, into the container proper 7 from the opening of the tip of the nozzle portion 3. As the compressed air discharges into the container proper 7, the developer in the container proper 7 is moved by the air toward the outlet 7*a*, and is discharged from the outlet 7*a*.

As the force applied to push the switch portion 1 by the image forming apparatus is removed, the switch portion 1 is moved in the opposite direction of the container proper from the outlet 7*a* by the force being applied to the switch portion 1 by the above-mentioned pressing means 26, and returns to the initial position, in which the passage between the nozzle portion 3 and air storage portion 2*a* is blocked by the switch portion 1. As a result, the compressed air in the storage portion 2*a* stops discharging from the opening of the tip of the nozzle portion 3.

As described above, the developer supply container 10 and image forming apparatus are structured so that the switch portion 1 of the developer supply container 10 is pressed or released by the image forming apparatus, and the length of the time the switch portion 1 is kept pressed by the image forming apparatus is controlled in proportion to the amount by which the developing device 201 needs to be supplied with the developer (amount by which developer has been consumed by developing device). In other words, the image forming apparatus is structured to keep the switch portion 1 pressed for a length of time proportional to the amount by which the developing device 201 needs to be supplied with the developer.

(Sealing Member)

The developer supply container 10 is provided with a sealing member 4, a sealing member 6*a*, and a sealing member 6*b*. The sealing member 4 is kept compressed by the container shutter 5 to keep sealed the gap between the outlet 7*a* and container shutter 5. The compression ratio of a sealing member, which is defined below, is desired to be in a range of 10%-70%. In this embodiment, it is 30%.

Compression Ratio (%)=(thickness of sealing member in compressed state)/(thickness of sealing member in uncompressed state)×100.

The sealing member 4 is formed of polyurethane foam. However, the material for the sealing member 4 does not need to be limited to polyurethane foam. In other words, any of various known elastic sealing members may be used in place of the sealing member 4.

The sealing member 6*a* is given the function of keeping sealed the gap between the air storage canister 2 and the housing of the driving portion 8. This sealing member 6*a* also may be replaced with any of various known elastic sealing members.

It should be noted here that the sealing member 6*a* can be eliminated by extremely precisely forming the air storage canister 2 and the housing of the driving portion 8 in terms of measurement so that the two can be perfectly fitted by pressing the former into the latter.

The sealing member 6*b* is given the function of keeping sealed the adjacencies of the nozzle portion 3 while remaining slidable along the nozzle portion 3. As for the choice of a sealing member usable as the sealing member 6*b*, any of various known elastic sealing members is acceptable, for example, a sealing member formed of felt, sponge, a foamed substance, an oil seal, etc. In this embodiment, an oil seal is used as the sealing member 6*b*.

(Mounting of Developer Supply Container)

The procedure for mounting the developer supply container 10 is as follows.

As it is detected by the image forming apparatus that the developer supply container 10 is completely (or nearly) depleted of the developer, a message which indicates the need for the replacement of the developer supply container 10 is displayed on the control panel (unshown) of the apparatus main assembly 100.

The user responds to the displayed message: The door 14 for replacing the developer supply container 10 in the apparatus main assembly 100 is opened by the user, the outlet 7*a* is sealed by the function of the shutter 15, and the developer supply container 10 depleted of the developer is removed from the apparatus main assembly 100.

Incidentally, the developer supply container 10 and apparatus main assembly 100 may be structured to tie the movement of the container shutter 5 to the movement of the developer supply container replacement door 14 so that as the door 14 is opened or closed, the opening of the outlet 7*a* is sealed or unsealed by the container shutter 5.

After the removal of the empty developer supply container 10 from the apparatus main assembly 100, the user is to mount a brand-new developer supply container 10 into the apparatus main assembly 100. After the mounting of the brand-new developer supply container 10, the opening of the outlet 7*a* is unsealed by the function of the shutter 15. Then, the door 14 is to be closed to complete the procedure for mounting the developer supply container 10 into the apparatus main assembly 100.

The shutter 15 and door 14 are each provided with a stopper so that the door 14 cannot be closed unless the shutter 15 is moved to the open position, and also, so that after the closing of the door 14, the shutter 15 cannot be operated.

Similarly, as the shutter 15 is slid into the open position by pushing it by the tab portion 15*c* thereof, the developer supply container 10 is fastened to the apparatus main assembly 100 by a stopper different from the stopper of the shutter 15, making it impossible to remove the developer supply container 10.

With the employment of the above-described two or more stoppers, it is prevented that the developer supply container 10 is removed from the apparatus main assembly 100 while its outlet 7*a* is open, and also, that the developing apparatus is activated while the developer supply container 10 is in the closed state.

Next, referring to FIGS. 4-7, the movements of the various portions of the developer supply container 10 and apparatus main assembly 100, which occur while the developer supply container 10 is in the main assembly 100, will be described in detail.

Figure 4:
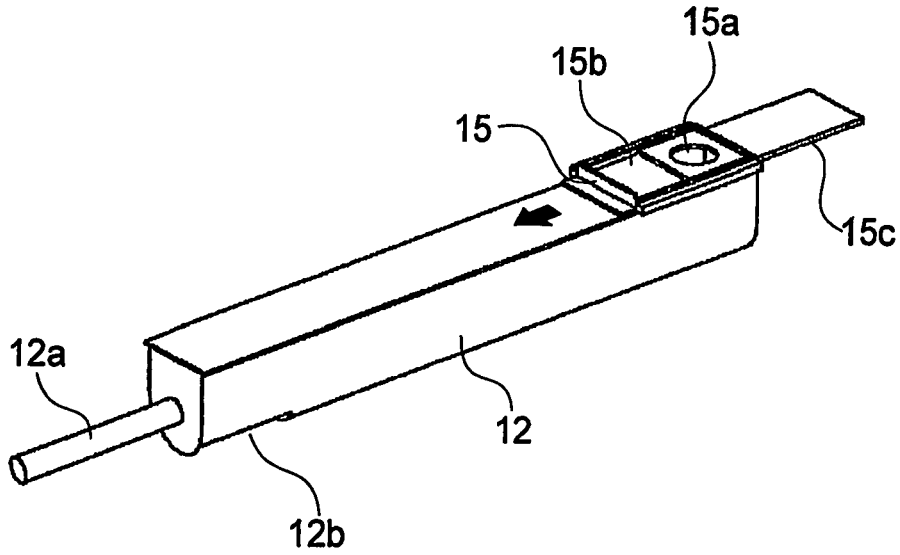
FIG. 4 is a perspective view of the shutter 15 and developer conveying portion 12 of the developer supply container according to the first embodiment of the present invention, prior to the opening of the shutter 15.
Figure 5:
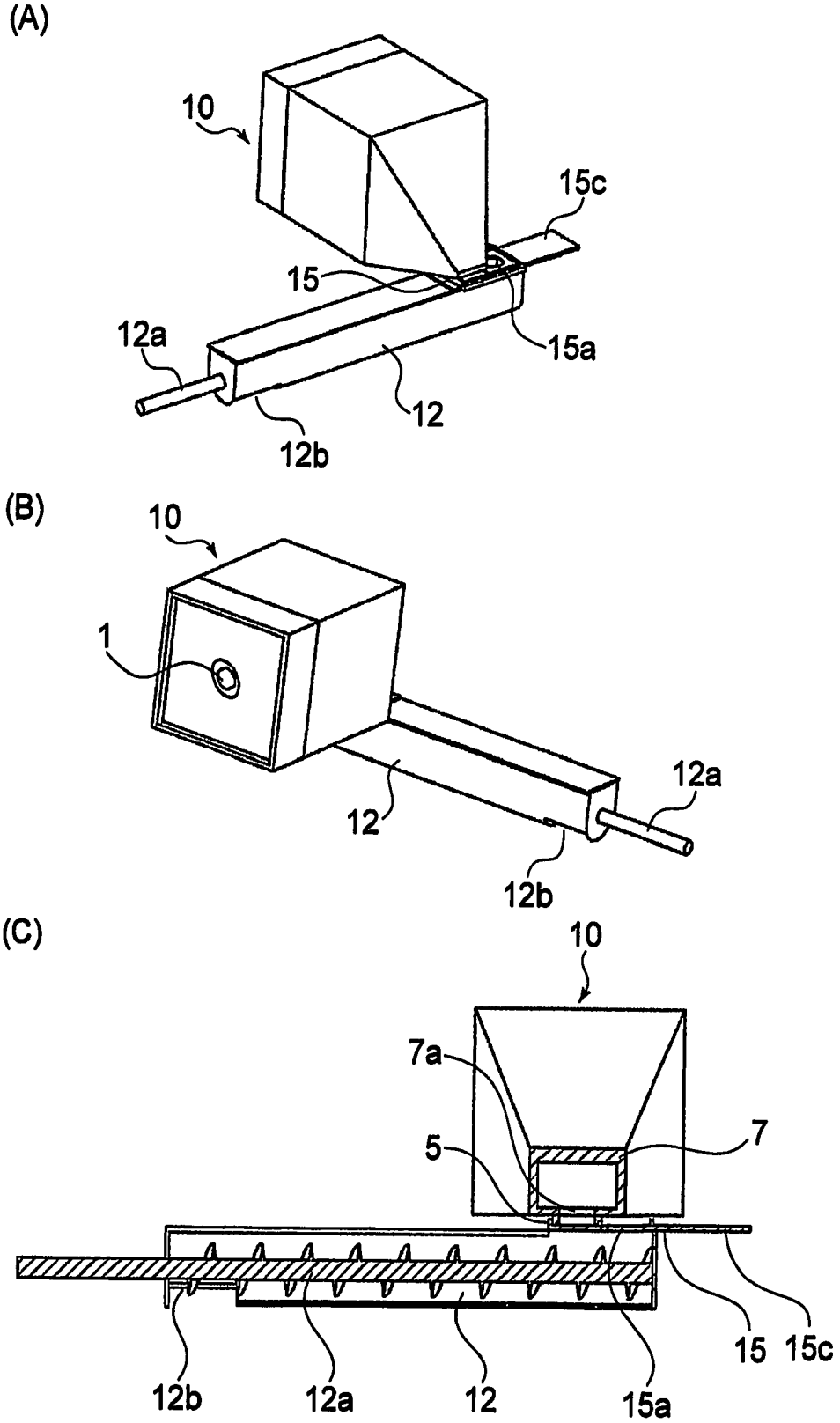
FIGS. 5(A) and 5(B) are perspective views, different in view angle, of the developer supply container in the main assembly of an image forming apparatus, prior to the opening of the shutter 15, according to the first embodiment of the present invention.
FIG. 5(C) is a sectional view of the developer supply container in the main assembly of an image forming apparatus, prior to the opening of the shutter 15, in the first embodiment of the present invention.

FIG. 4 is a perspective view of the shutter 15 in the closed position, and developer conveying portion 12.

FIGS. 5(A) and 5(B) are perspective views 1 and 2, respectively, of the shutter 15 in the closed position, developer conveying portion 12, and developer supply container 10 in the apparatus main assembly 100, and FIG. 5(C) is a vertical sectional view of the shutter 15 in the closed position, developer conveying portion 12, and developer supply container 10 in the apparatus main assembly 100.

The shutter 15 is provided with the tab portion 15*c*, which is integral with the main portion of the shutter 15. The main portion of the shutter 15 is provided with a circular hole 15*a* which is 10 mm in radius. The shutter 15 is attached to the developer conveying portion 12, so that it can be reciprocally moved in the direction indicated by an arrow mark in FIG. 4.

As the developer supply container 10 is mounted into the image forming apparatus, the container shutter 5 is engaged with the shutter seat 15*b* of the shutter 15, being thereby firmly held by the shutter seat 15*b* (shutter 15). It is in this condition that the user is to slide the shutter 15 by grasping the tab portion 15*c*. As the shutter 15 is slid, the container shutter 5 is moved with the shutter 15 in the direction indicated by the arrow mark in FIG. 4, because the container proper 7 of the developer supply container 10 is virtually immovably held to the image forming apparatus. As a result, the hole 15*a* of the shutter 15 aligns with the opening of the outlet 7*a* of the container proper 7, allowing the developer in the container proper 7 to be supplied to the developing device 201.

Figure 6:
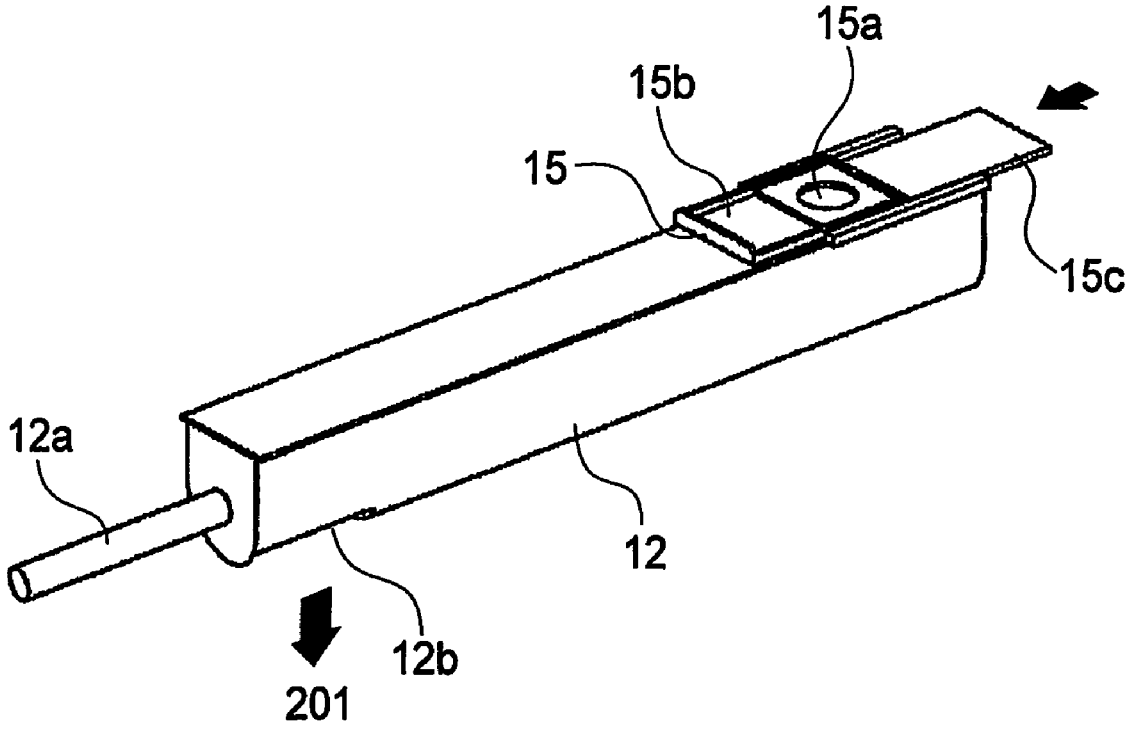
FIG. 6 is a perspective view of the shutter 15 and developer conveying portion 12 according to the first embodiment of the present invention, after the opening of the shutter 15.
Figure 7:
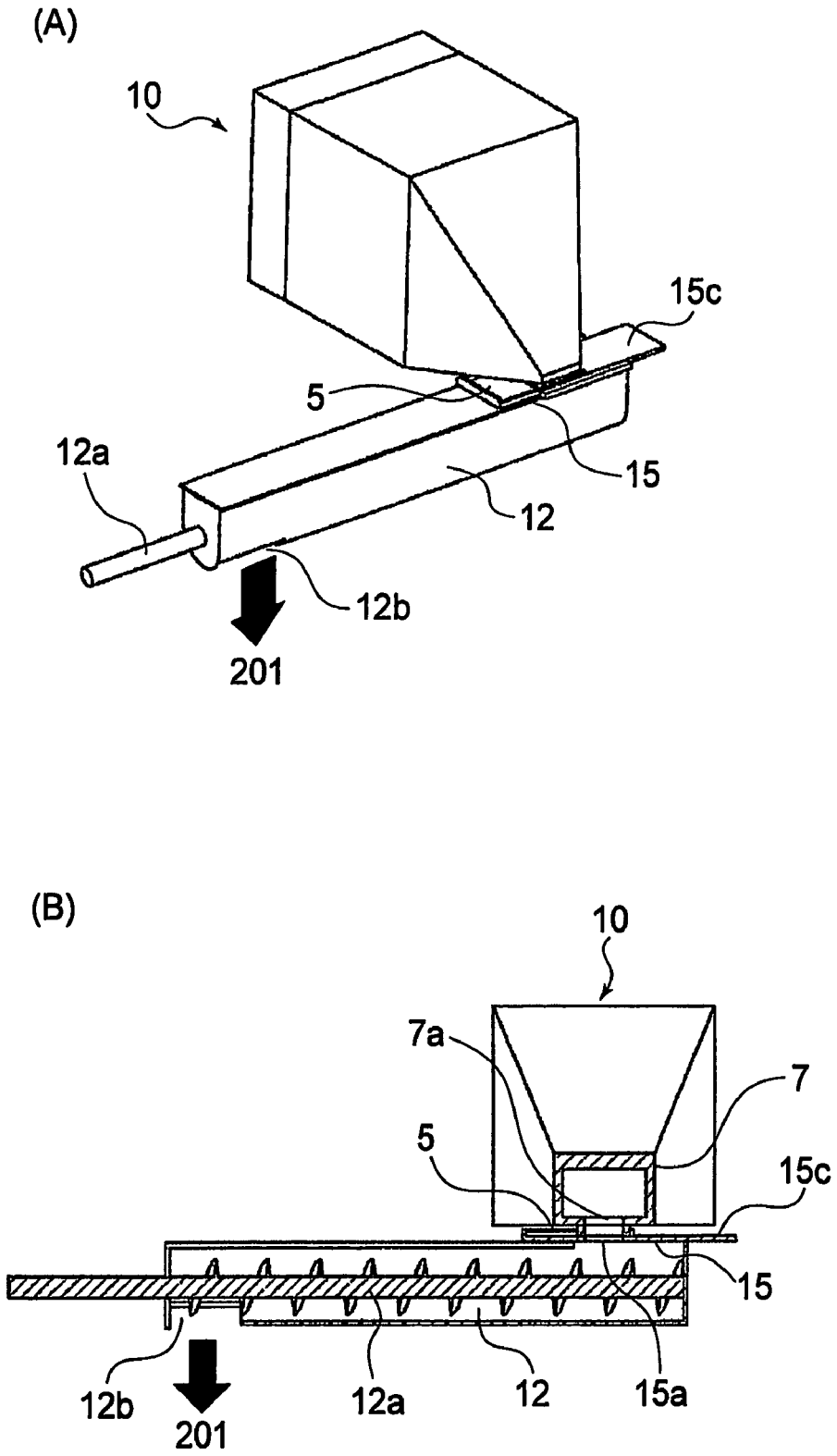
FIG. 7(A) is a perspective view of the developer supply container in the main assembly of an image forming apparatus, after the opening of the shutter 15, according to the first embodiment of the present invention.
FIG. 7(B) is a sectional view of the developer supply container in the main assembly of an image forming apparatus, after the opening of the shutter 15, in the first embodiment of the present invention.

FIG. 6 is a perspective view of the shutter 15 in the open position, and developer conveying portion 12. FIG. 7(A) is a perspective view of the shutter 15 in the open position, developer conveying portion 12, and unsealed developer supply container 10, in the apparatus main assembly 100, and FIG. 7(B) is a sectional view of the shutter 15 in the open position, developer conveying portion 12, and unsealed developer supply container 10, in the apparatus main assembly 100.

FIGS. 6 and 7(A) show the shutter 15, developer conveying portion 12, and unsealed developer supply container 10, in the apparatus main assembly 100, after the shutter 15 has been slid by being pushed by the tab portion 15*c* to place the hole 15*a* directly below the opening of the outlet 7*a* of the developer supply container 10.

FIG. 7(B) shows that a passage has been established between the hole 15*a* of the shutter 15 and the outlet 7*a* of the container proper 7.

As the hole 15*a* of the shutter 15 aligns with the opening of the outlet 7*a*, the developer is discharged into the developer conveying portion 12 from the container proper 7. Thereafter, the developer is conveyed toward the developing device 201 by a screw 12*a* disposed in the developer conveying portion 12. Then, the developer is supplied to the developing device 201 through the outlet 12*b* located at the end of the developer conveying portion 12.

(Discharge of Developer)

The discharge of the developer from the developer supply container 10 in the apparatus main assembly 100 is controlled by the control portion of the apparatus main assembly 100. The control portion controls the discharge based on the developer density detected by the developer density detecting means with which the developer conveying portion 12 or developing device 201 is provided.

That is, if it is determined based on the detected developer density that the amount of the developer in the developing device 201 is insufficient, the control portion outputs the signal for pressing the switch portion 1 in order to discharge the developer from the developer supply container 10.

Referring to FIG. 5(A), the developer supply container 10 is mounted into the apparatus main assembly 100 so that the opening of the outlet 7*a* faces downward.

Incidentally, when it seems that the developer has become lumped in the developer supply container 10, the developer supply container 10 may be shaken several times before it is mounted into the apparatus main assembly 100.

As the switch portion 1 is pressed by the apparatus main assembly 100 activated by the control portion, the nozzle portion 3 becomes connected to the air storage portion 2*a*, allowing the compressed air to discharge by its own pressure into the container proper 7 through the nozzle portion 3.

After having discharged into the container proper 7, the air moves into the developer conveying portion 12 through the outlet 7*a*, and then, into the image forming apparatus main assembly 100 through an air vent (unshown) in the top wall of the developer conveying portion 12.

This air vent is provided with a filter, which allows air to pass, but does not allow the developer to pass.

Next, the air storage canister 2 will be described in detail.

The internal pressure of the air storage canister 2 is desired to be in a range of 10 kPa-150 kPa. In this embodiment, the initial internal pressure of the air storage canister 2 is 100 kpa.

As for the material for the air storage canister 2, it is desired to be a metal such as aluminum. However, as long as the internal pressure of the air storage canister 2 is kept below the 30 kpa, it may be resin. In this embodiment, the air storage canister 2 is formed of aluminum.

As for the amount of air flow, it is desired to be in a range of 0.5 (l/Min)-10 (l/Min). In this embodiment, it is set to 3 (l/Min).

In the tests in which the developer was discharged and conveyed using the developer supply container 10 and apparatus main assembly 100 structured as described, the amount by which the developer was supplied (developer was discharged) was properly controlled from the beginning to the end of the usage of the developer supply container 10.

In this embodiment, the developer supply container 10 is structured so that the jetting of air is used for the conveyance and discharge of the developer. This method of using a jet of air is very effective to cause the lumps of developer, which are clinging to the internal surface of the developer supply container 10, to fall. Therefore, the amount of the developer which otherwise remains unusable in the developer supply container 10 can be reduced to virtually zero. For the purpose of efficiently causing the lumps of developer clinging to the internal surface of the developer supply container 10, to fall, the internal pressure of the air storage canister 2 is desired to be no less than 50 kpa.

Incidentally, letting compressed air jet out into the container proper 7 is also very effective to loosen the developer having lumped during the distribution of the developer supply container 10.

Lastly, the method for reusing the developer supply container 10 will be described.

The developer supply-container 10 in this embodiment is reusable. As for the method for reusing the developer supply container 10, first, the used developer supply container 10 is recovered and is disassembled. After the disassembly, the air storage canister 2 is refilled with air through an air refilling process. The developer storage portion is blown clean by an air blower. Thereafter, the developer supply container 10 is reassembled from various components, such as the air storage canister 2, resulting from its disassembly. The sealing members and the like may be replaced as necessary. After the developer supply container 10 is reassembled, it is filled with a predetermined amount of developer to complete the process of refurbishing the developer supply container 10.

The developer supply container 10 in this embodiment described above possesses its own power source for conveying and discharging the developer therein, being not required to receive power from the main assembly of an image forming apparatus, and therefore, making it possible to eliminate the need for providing the main assembly with a power source dedicated to driving of the developer supply container 10. Therefore, the employment of the developer supply container 10 structured as described above affords more latitude in the placement of the developer supply container 10 in the apparatus main assembly.

In other words, the employment of the developer supply container 10 in this embodiment affords more latitude in designing the main assembly of an image forming apparatus as well as the developer supply container therefor, without increasing the cost of the main assembly, and therefore, it contributes to increasing the developer supply container in capacity and reducing in size the apparatus main assembly.

Further, the employment of the developer supply container 10 in this embodiment can reduce the amount of energy required of the main assembly by an amount equal to the amount of energy required to drive the developer supply container (energy dedicated to driving a powder pump). In other words, it contributes to reducing the amount of energy used by the main assembly.

Embodiment 2

Next, the second embodiment of the present invention will be described.

The second embodiment of the present invention will be described referring to FIG. 8.

Figure 8:
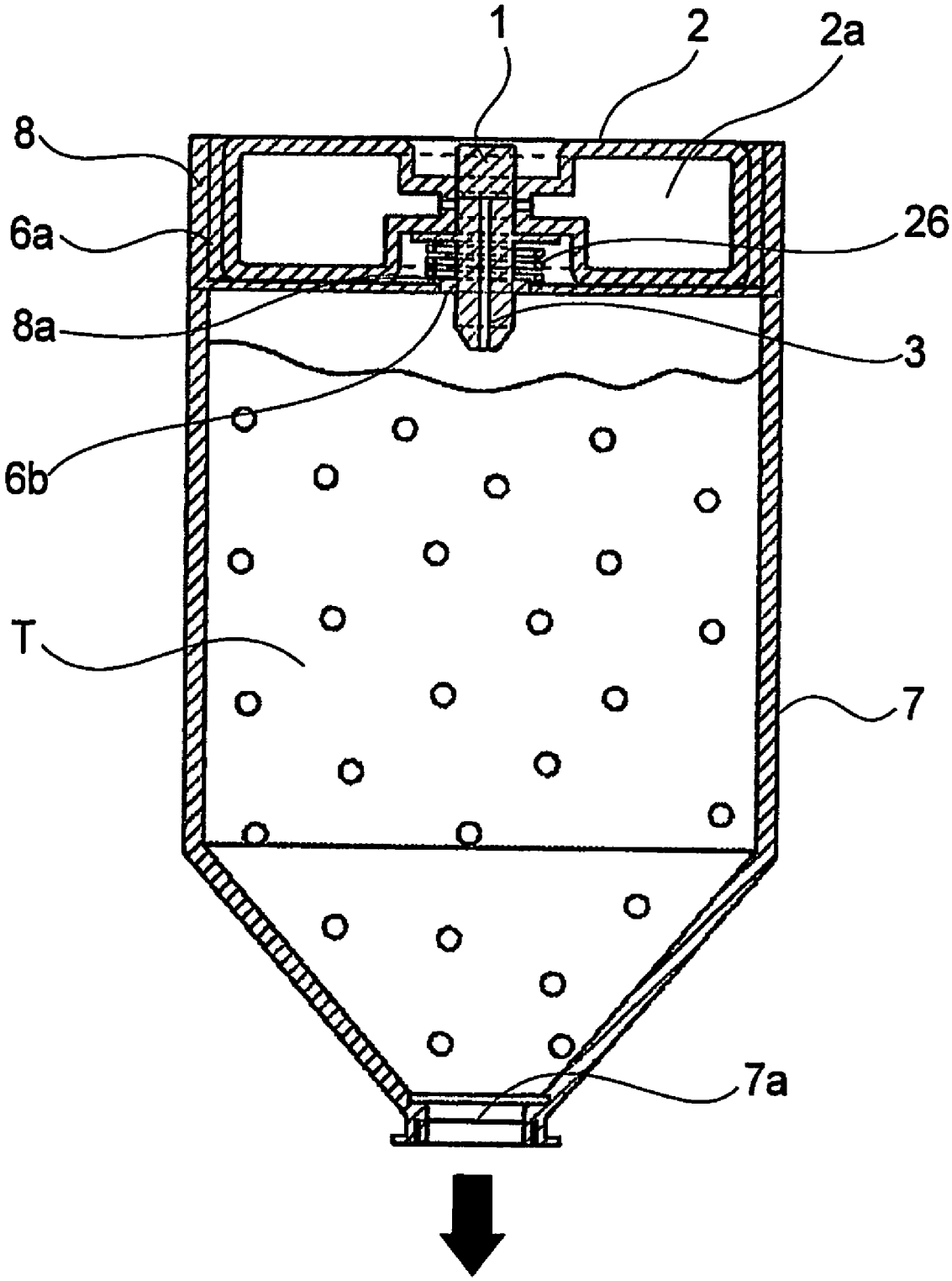
FIG. 8 is a sectional view of the developer supply container 10 according to a second embodiment of the present invention.

FIG. 8 is a sectional view of the developer supply container 10 in the second embodiment of the present invention.

The structures of the container shutter 5, sealing member 4, and apparatus main assembly 100, in this embodiment are the same as those in the first embodiment, and therefore, will not be described.

The discharge of developer from the developer supply container 10 in this embodiment in the apparatus main assembly 100 is controlled by the control portion of the apparatus main assembly 100 as in the first embodiment.

The developer supply container 10 is mounted into the developing apparatus main assembly 100 so that the opening of the outlet 7*a* faces downward. Therefore, as the container shutter 5 is opened, the developer in the developer supply container 10 falls out of the outlet 7*a* by a small amount, but most of the developer remains in the container proper 7.

Thereafter, the discharge of the developer from the developer supply container 10 in the apparatus main assembly 100 is controlled by the control portion of the apparatus main assembly 100 based on the developer density detected by the developer density detecting means with which the developer conveying portion 12 or developing device 201 is provided, as in the first embodiment. That is, if it is determined based on the detected developer density that the amount of the developer in the developing device 201 is insufficient, the control portion outputs the signal for pressing the switch portion 1 in order to discharge the developer from the developer supply container 10. As the switch portion 1 is pressed, the passage between the nozzle portion 3 and air storage portion 2*a* is opened, allowing the compressed air in the air storage portion 2*a* to jet by its own pressure through the nozzle portion 3, by which the developer is supplied to the apparatus main assembly 100.

Next, the method for reusing the developer supply container 10 in this embodiment will be described.

The developer supply container 10 in this embodiment is also reusable. As for the method for reusing this developer supply container 10, first, the used developer supply container 10 is recovered and is disassembled. After the disassembly, the air storage canister 2 is refilled with air through an air refilling process. The developer storage portion is blown clean by an air blower. Thereafter, the developer supply container 10 is reassembled from various components, such as the air storage canister 2, resulting from the disassembly of the used developer supply container 10. The sealing members and the like may be replaced as necessary during the reassembly. After the developer supply container 10 is reassembled, it is filled with a predetermined amount of developer to complete the process of refurbishing the developer supply container 10.

The developer supply container 10 in this embodiment is structured so that the axial line of the outlet 7*a* is parallel with the axial line of the switch portion 1, and also, so that the portion of the developer container 10, which will be the bottom side when the container 10 is in the apparatus main assembly 100, is shaped so that the developer in the container 10 will collect, due to its own weight, to the outlet 7*a*. Therefore, the developer in the developer supply container 10 is efficiently discharged even when the amount by which the air jets out of the air storage portion 2*a* is rather small.

Embodiment 3

Next, the third embodiment of the present invention will be described.

The third embodiment of the present invention will be described referring to FIG. 9.

Figure 9:
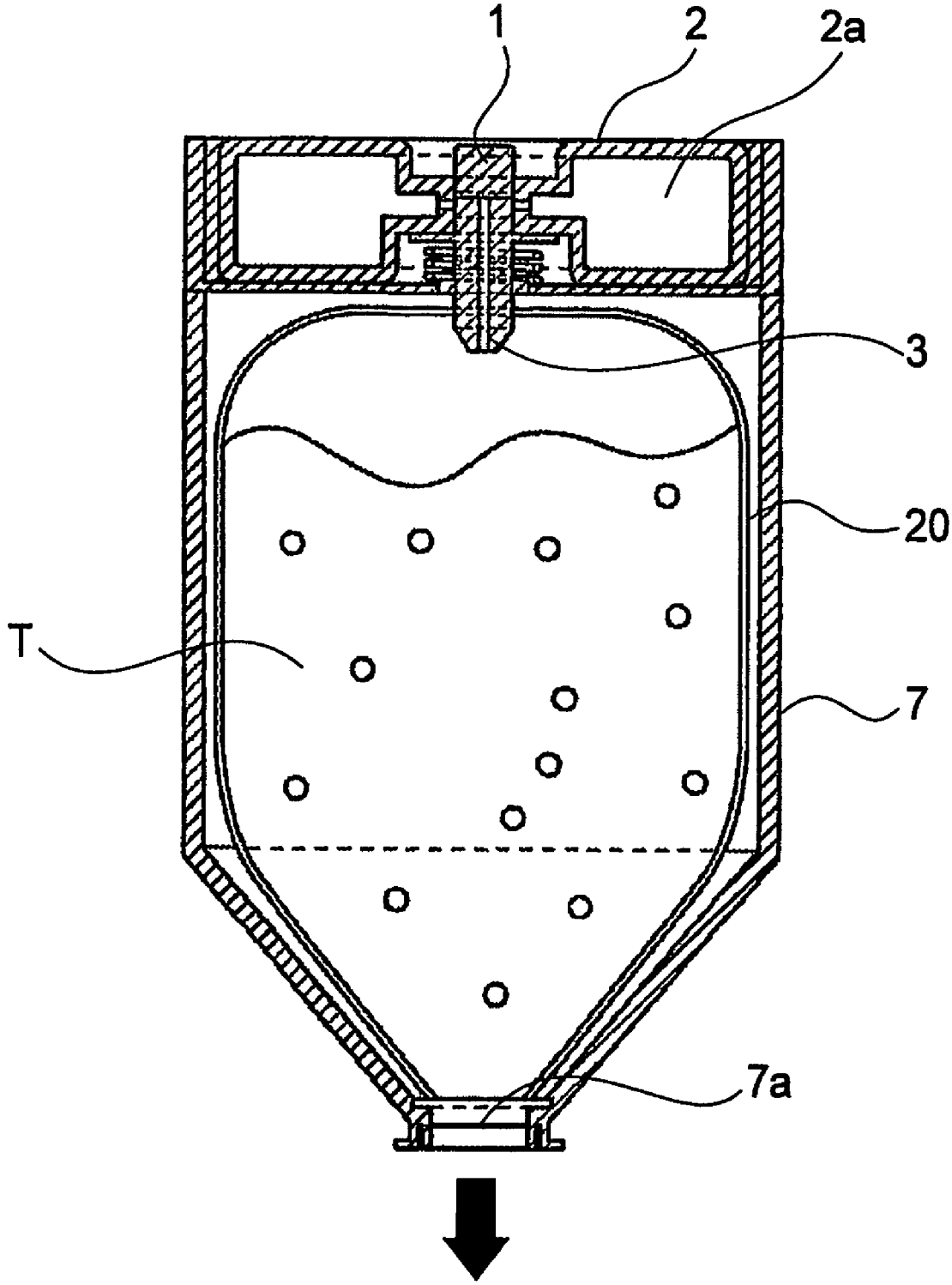
FIG. 9 is a sectional view of the developer supply container 10 according to a third embodiment of the present invention.

FIG. 9 is a sectional view of the developer supply container 10 in the third embodiment of the present invention.

The structures of the container shutter 5, sealing member 4, and apparatus main assembly 100, in this embodiment are the same as those in the first embodiment, and therefore, will not be described.

Referring to FIG. 9, the developer supply container 10 is provided with a developer storage pouch 20 as a developer conveying means, which is disposed within the developer supply container 10.

The discharge of developer from the developer supply container 10 in the apparatus main assembly 100 is controlled by the control portion of the apparatus main assembly 100 as in the first embodiment.

The developer supply container 10 is mounted into the developing apparatus main assembly 100 so that the opening of the outlet 7*a* faces downward. Therefore, at the beginning of the opening of the container shutter 5, the developer in the developer supply container 10 falls out of the outlet 7*a* by a small amount, but most of the developer remains in the container proper 7.

Thereafter, the discharge of the developer from the developer supply container 10 in the apparatus main assembly 100 is controlled by the control portion of the apparatus main assembly 100 based on the developer density detected by the developer density detecting means with which the developer conveying portion 12 or developing device 201 is provided, as in the first embodiment. That is, if it is determined based on the detected developer density that the amount of the developer in the developing device 201 is insufficient, the control portion presses the switch portion 1 in order to discharge the developer from the developer supply container 10. Pressing of the switch portion 1 opens the passage between the nozzle portion 3 and air storage portion 2*a*, allowing the compressed air in the air storage portion 2*a* to jet by its own pressure through the nozzle portion 3. As a result, the internal pressure of the developer storage pouch 20 is increased. Consequently, the developer in the pouch 20 is forced out of the pouch 20 (developer supply container 10), into the apparatus main assembly 100, by the difference between the internal pressure of the pouch 20 and ambient pressure.

The developer storage pouch 20 is vigorously vibrated by the jetting of the compressed air. Therefore, the lumps of developer adhering to the internal surface of the developer storage pouch 20 are made to fall toward the outlet 7*a* by these vibrations, and then, are discharged from the outlet 7*a* by the subsequent jetting of the compressed air.

Next, the method for reusing the developer supply container 10 in this embodiment will be described.

The developer supply container 10 in this embodiment is also reusable. As for the method for reusing this developer supply container 10, first, the used developer supply container 10 is recovered and is disassembled. After the disassembly, the air storage canister 2 is refilled with air through an air refilling process. The used developer storage pouch 20 is replaced with a brand-new developer storage pouch 20. Thereafter, the developer supply container 10 is reassembled from various components, such as the air storage canister 2, resulting from the disassembly of the used developer supply container 10. The sealing members and the like may be replaced as necessary during the reassembly. After the developer supply container 10 is reassembled, it is filled with a predetermined amount of developer to complete the process of refurbishing the developer supply container 10.

The developer supply container 10 in this embodiment is larger in component count than in the preceding embodiments. However, the employment of this developer supply container 10 reduced the amount by which the developer in the developer supply container 10 failed to be discharged.

Regarding the method of reusing the used developer supply container 10, this developer supply container 10 eliminates the process of cleaning the container proper 7. Therefore, it can substantially increase the efficiency with which the used developer supply container 10 is refurbished, in spite of the fact that this developer supply container 10 is greater in component count than the developer supply containers 10 in the preceding embodiments.

Incidentally, in this embodiment, the developer supply container 10 was structured so that the axial line of the outlet 7*a* is parallel with the axial line of the switch portion 1. However, it may be structured so that the axial line of the outlet 7*a* is perpendicular to the axial line of the switch portion 1 as in the first embodiment. Such a structural arrangement is just as high in developer conveyance efficiency as the structural arrangement for the developer supply container 10 in this embodiment.

Embodiment 4

Next, the fourth embodiment of the present invention will be described.

The fourth embodiment of the present invention will be described referring to FIG. 10.

Figure 10:
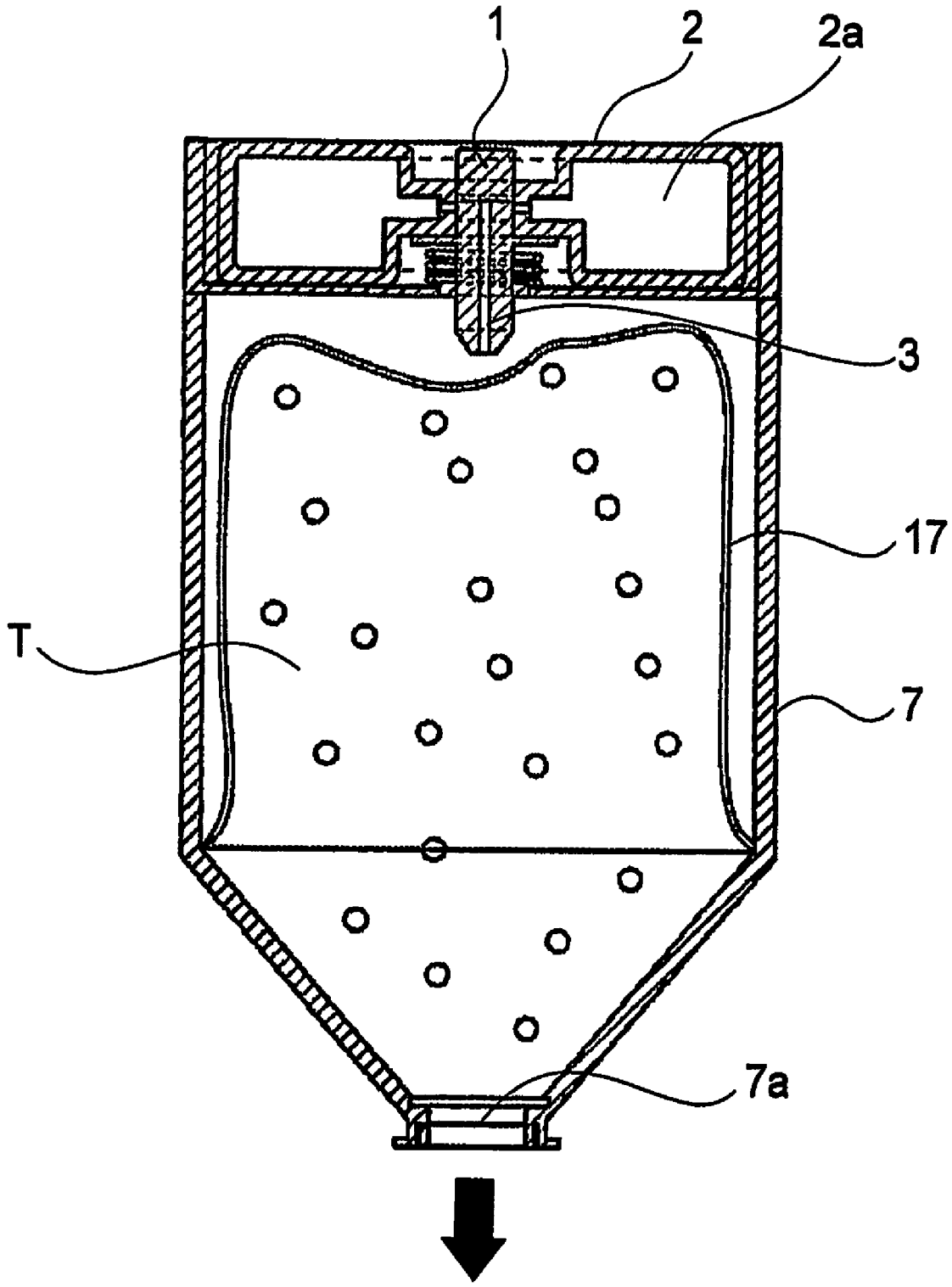
FIG. 10 is a sectional view of the developer supply container 10 according to a fourth embodiment of the present invention.

FIG. 10 is a sectional view of the developer supply container 10 in the fourth embodiment of the present invention. The structures of the container shutter 5, sealing member 4, and apparatus main assembly 100, in this embodiment are the same as those in the first embodiment, and therefore, will not be described.

Referring to FIG. 10, the developer supply container 10 is provided with a developer extruding pouch 17 as a developer conveying means, which is disposed within the developer supply container 10.

The discharge of developer from the developer supply container 10 in the apparatus main assembly 100 is controlled by the control portion of the apparatus main assembly 100 as in the first embodiment. More specifically, the discharge of the developer from the developer supply container 10 is controlled by the control portion of the apparatus main assembly 100 based on the developer density detected by the developer density detecting means with which the developer conveying portion 12 or developing device 201 is provided, as in the first embodiment.

That is, if it is determined based on the detected developer density that the amount of the developer in the developing device 201 is insufficient, the control presses the switch portion 1 in order to discharge the developer from the developer supply container 10. Pressing of the switch portion 1 opens the passage between the nozzle portion 3 and air storage portion 2*a*.

As a result, the compressed air in the air storage portion 2*a* jets out by its own pressure through the nozzle portion 3, into the space between the developer extruding pouch 17 and the external wall of the container proper 7 of the developer supply container 10, increasing thereby the internal pressure of this space. Consequently, the developer extruding pouch 17 is moved toward the outlet 7*a* by the increased pressure.

As the developer extruding pouch 17 is moved toward the outlet 7*a*, the developer in the pouch 17 is extruded (discharged) through the outlet 7*a*. Incidentally, while the developer extruding pouch 17 is moved toward the outlet 7*a*, it is vibrated, and the vibrations are effective to shake down the lumps of developer T adhering the internal surface of the developer extruding pouch 17.

Next, the method for reusing the developer supply container 10 in this embodiment will be described.

The developer supply container 10 in this embodiment is also reusable. As for the method for reusing this developer supply container 10, first, the used developer supply container 10 is recovered and is disassembled. After the disassembly, the air storage canister 2 is refilled with air through an air refilling process. The used developer extruding pouch 17 may be replaced with a brand-new developer extruding pouch 17, or may be blown clean by an air blower. Thereafter, the developer supply container 10 is reassembled from various components, such as the air storage canister 2, resulting from the disassembly of the used developer supply container 10. The sealing members and the like may be replaced as necessary during the reassembly. After the developer supply container 10 is reassembled, it is filled with a predetermined amount of developer to complete the process of refurbishing the developer supply container 10.

In the case of the developer supply container 10 in this embodiment, the air allowed to jet out of the air storage portion does not travel to the developer conveying portion 12 of the apparatus main assembly 100, making it unnecessary to provide the developer conveying portion 12 with an air vent (unshown) such as the one in the first embodiment, contributing thereby to simplifying the apparatus main assembly 100 in structure.

In this embodiment, the developer supply container 10 is structured so that the axial line of the outlet 7*a* is parallel with the axial line of the switch portion 1. However, it may be structured so that the axial line of the outlet 7*a* is perpendicular to the axial line of the switch portion 1 as in the first embodiment. Such a structural arrangement is just as high in developer conveyance efficiency as the structural arrangement for the developer supply container 10 in this embodiment.

Embodiment 5

Next, the fifth embodiment of the present invention will be described.

The fifth embodiment of the present invention will be described referring to FIG. 11.

Figure 11:
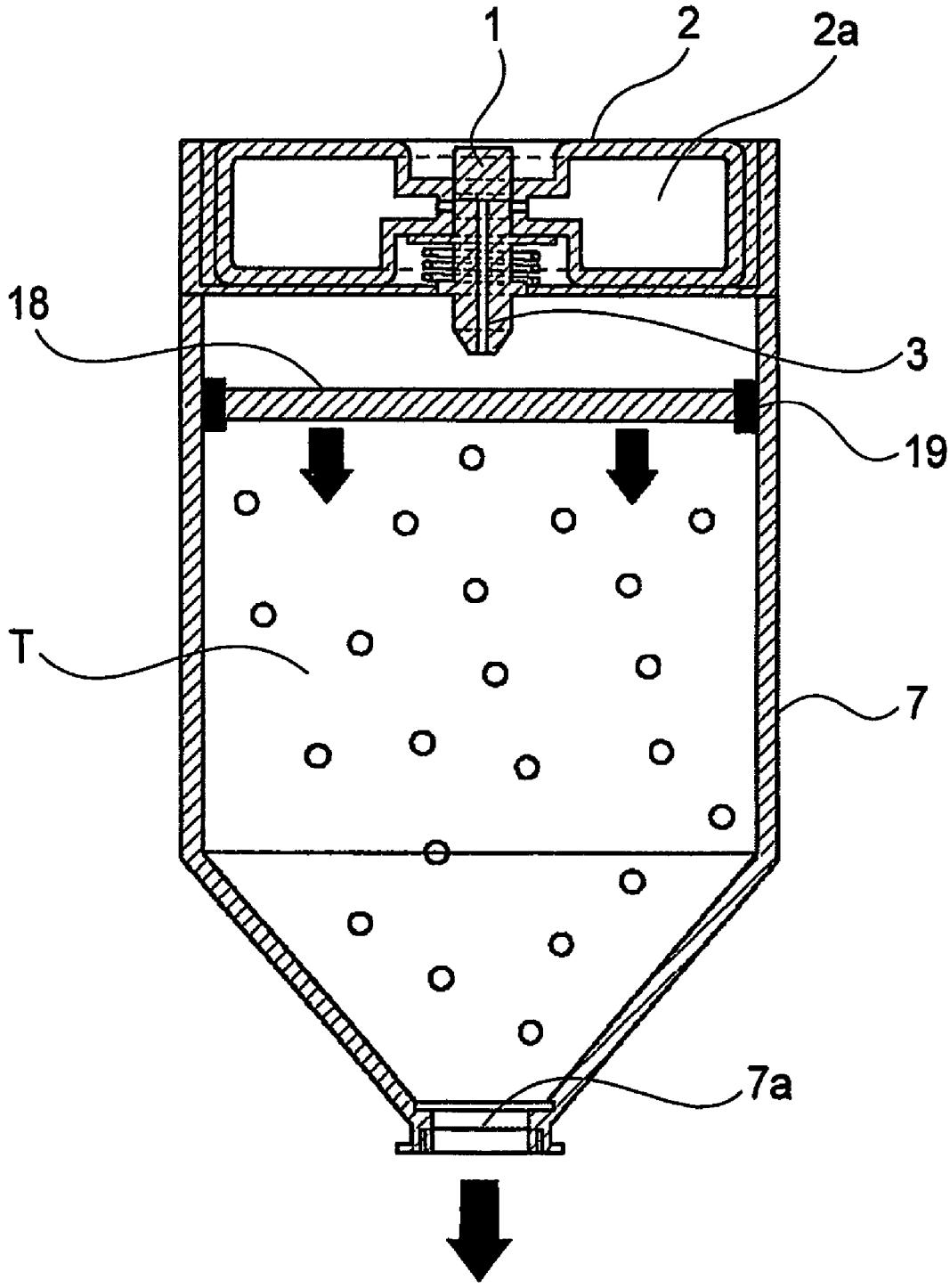
FIG. 11 is a sectional view of the developer supply container 10 according to a fifth embodiment of the present invention.

FIG. 11 is a sectional view of the developer supply container 10 in the fifth embodiment of the present invention.

The structures of the container shutter 5, sealing member 4, and apparatus main assembly 100, in this embodiment are the same as those in the first embodiment, and therefore, will not be described.

Referring to FIG. 11, the developer supply container 10 is provided with a movable member 18 in the form of a piece of board as a conveying means, which is disposed within the developer supply container 10.

The discharge of developer from the developer supply container 10 in the apparatus main assembly 100 is controlled by the control portion of the apparatus main assembly 100 as in the first embodiment. More specifically, the control portion controls the discharge of the developer from the developer supply container 10, based on the developer density detected by the developer density detecting means with which the developer conveying portion 12 or developing device 201 is provided, as in the first embodiment.

That is, if it is determined based on the detected developer density that the amount of the developer in the developing device 201 is insufficient, the control portion presses the switch portion 1 in order to discharge the developer from the developer supply container 10. Pressing of the switch portion 1 opens the passage between the nozzle portion 3 and air storage portion 2*a*.

As a result, the compressed air in the air storage portion jets out by its own pressure into the space surrounded by the movable member 18 and the external wall of the container proper 7, increasing thereby the internal pressure of the space. Consequently, the movable member 18 is moved toward the outlet 7*a* by the increased pressure.

As the movable member 18 is moved toward the outlet 7*a*, the developer in the container proper 7 is discharged through the outlet 7*a* as if it is squeezed out of the developer supply container 10. Incidentally, a sealing member 19 is disposed between the internal surface of the container proper 7 and movable member 18 in order to prevent a pressure leak.

Next, the method for reusing the developer supply container 10 in this embodiment will be described.

The developer supply container 10 in this embodiment is also reusable. As for the method for reusing this developer supply container 10, first, the used developer supply container 10 is recovered and is disassembled. After the disassembly, the air storage canister 2 is refilled with air through an air refilling process. The used movable member 18 is blown clean by an air blower, and then, is used along with the various components, such as the air storage canister 2, resulting from the disassembly of the used developer supply container 10 to reassemble the developer supply container 10. The sealing members and the like may be replaced as necessary during the reassembly. After the developer supply container 10 is reassembled, it is filled with a predetermined amount of developer to complete the process of refurbishing the developer supply container 10.

Incidentally, in this embodiment, the developer supply container 10 was structured so that the axial line of the outlet 7*a* is parallel with the axial line of the switch portion 1. However, it may be structured so that the axial line of the outlet 7*a* is perpendicular to the axial line of the switch portion 1 as in the first embodiment. Such a structural arrangement is just as high in developer conveyance efficiency as the structural arrangement for the developer supply container 10 in this embodiment.

Embodiment 6

Next, the sixth embodiment of the present invention will be described.

The sixth embodiment of the present invention will be described referring to FIG. 12.

Figure 12:
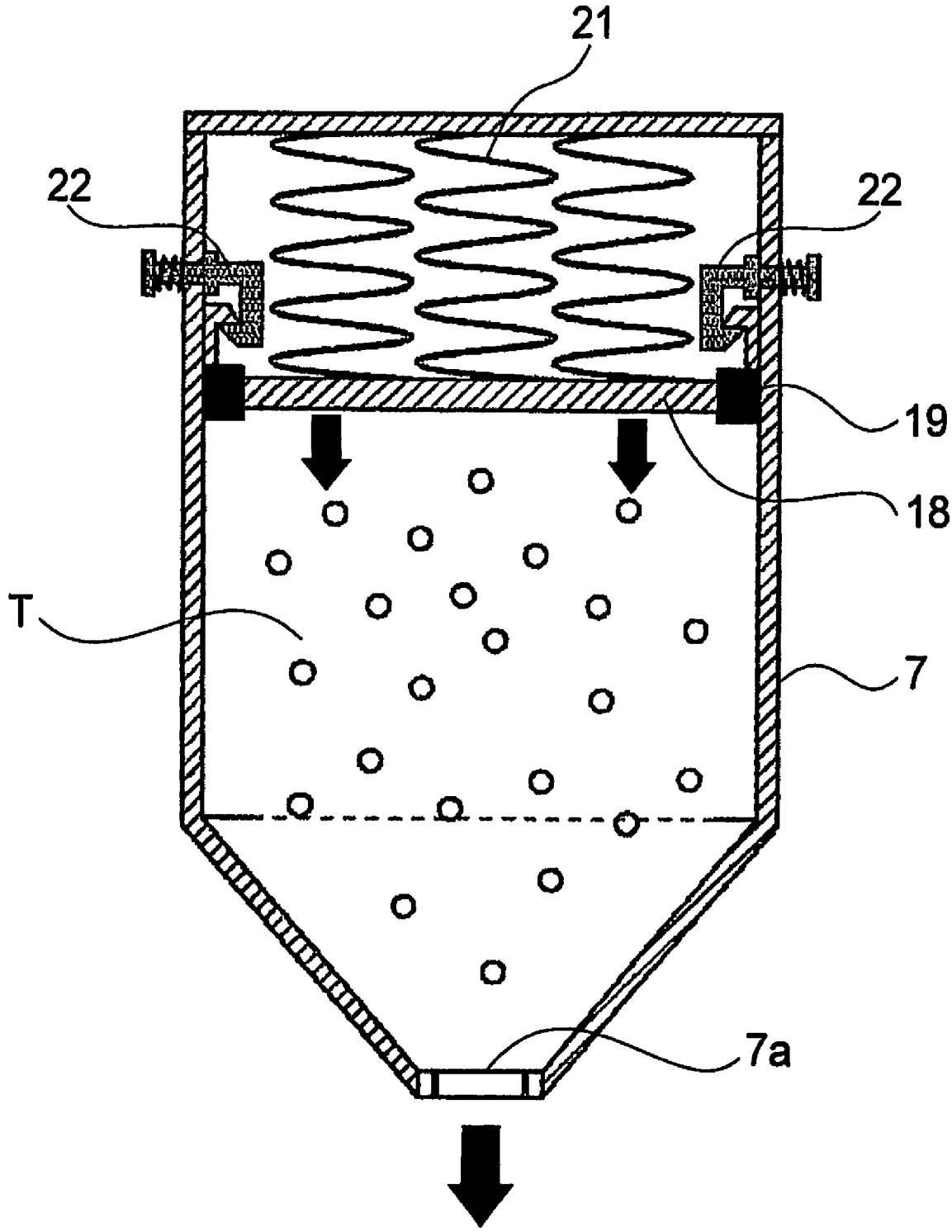
FIG. 12 is a sectional view of the developer supply container 10 according to a sixth embodiment of the present invention.

FIG. 12 is a sectional view of the developer supply container 10 in the sixth embodiment of the present invention.

The structures of the container shutter 5, sealing member 4, shutter 15, etc., in this embodiment are the same as those in the first embodiment, and therefore, will not be described.

Referring to FIG. 12, the developer supply container 10 is also provided with a movable member 18 in the form of a piece of board as a conveying means, which is similar to that in the fifth embodiment and is disposed within the developer supply container 10.

However, the developer supply container 10 in this embodiment is not provided with the air storage canister 2, with which the developer supply containers 10 in the preceding embodiments are provided. Instead, the developer supply container 10 in this embodiment is provided with a plurality of springs 21 as a power source.

The movable member 18 in the developer supply container 10 is kept pressed toward the outlet 7*a* by the springs 21, although it is held immovable by a pair of stoppers 22 during distribution.

The stoppers 22 in this embodiment protrude outward from the container proper 7. In consideration of the impacts to which the developer supply container 10 might be subjected during distribution, the container proper 7 may be provided with a pair of recesses in which the stoppers 22 are disposed, or may be provided with a pair of protective members for the stoppers 22.

After the mounting of the developer supply container 10 into the apparatus main assembly 100, the movable member 18 is released from the stoppers 22 by the stopper disengaging portion (unshown) of the apparatus main assembly 100, being thereby allowed to be moved toward the outlet 7*a*.

However, as the movable member 18 is moved a certain distance, it is stopped by the body of developer T in the container proper 7. Thereafter, the movable member 18 is repeatedly advanced toward the outlet 7*a* by a distance equivalent to the amount by which the developer T is conveyed into the developing device 201 through the developer conveying portion 12.

In this embodiment, the movable member 18 is continuously under the pressure from the springs 21. Therefore, once it is released from the stoppers 22, it continuously presses the body of developer T toward the outlet 7*a*. However, the body of developer T is prevented from continuously moving, by the screw 12*a* of the developer conveying portion 12. Therefore, there does not occur such a situation that the developer T is excessively conveyed to the developing device 201.

However, if the developer conveying portion 12 is insufficient in capacity, or the outlet 7*a* is too small, relative to the overall strength of the springs 21, it is possible that the developer T lumps up in the developer conveying portion 12, adjacencies of the outlet 7*a*, and/or the like location, and blocks the location. Therefore, the overall strength of the springs 21 is desired to be set according to the sizes of the developer conveying portion 12 and outlet 7*a*.

Next, the method for reusing the developer supply container 10 in this embodiment will be described.

The developer supply container 10 in this embodiment is also reusable. As for the method for reusing this developer supply container 10, first, the used developer supply container 10 is recovered and is disassembled. After the disassembly, the interior of the container proper 7 is blown clean by an air blower, and the movable member 18 is moved back into the position in which it engages with the stoppers 22. Then, the various components resulting from the disassembly of the used developer supply container 10 are reassembled into the developer supply container 10. The sealing members and the like may be replaced as necessary during the reassembly. After the developer supply container 10 is reassembled, it is filled with a predetermined amount of developer to complete the process of refurbishing the developer supply container 10.

Incidentally, in this embodiment, the developer supply container 10 was structured so that the axial line of the outlet 7*a* is parallel with the axial line of each of the plurality of springs 21. However, it may be structured so that the axial line of the outlet 7*a* is perpendicular to the axial line of each of the plurality of springs 21 as it was parallel with the axial line of the switch portion 1 in the first embodiment. Such a structural arrangement is just as high in developer conveyance efficiency as the structural arrangement for the developer supply container 10 in this embodiment. The utilization of the resiliency of the springs as the power source, instead of the pressure of the compressed air in the air storage canister 2 (inclusive of nozzle portion 3 and switch portion 1), promises a substantial amount of reduction in manufacturing cost.

Embodiment 7

Next, the seventh embodiment of the present invention will be described.

The seventh embodiment of the present invention will be described referring to FIG. 13.

Figure 13:
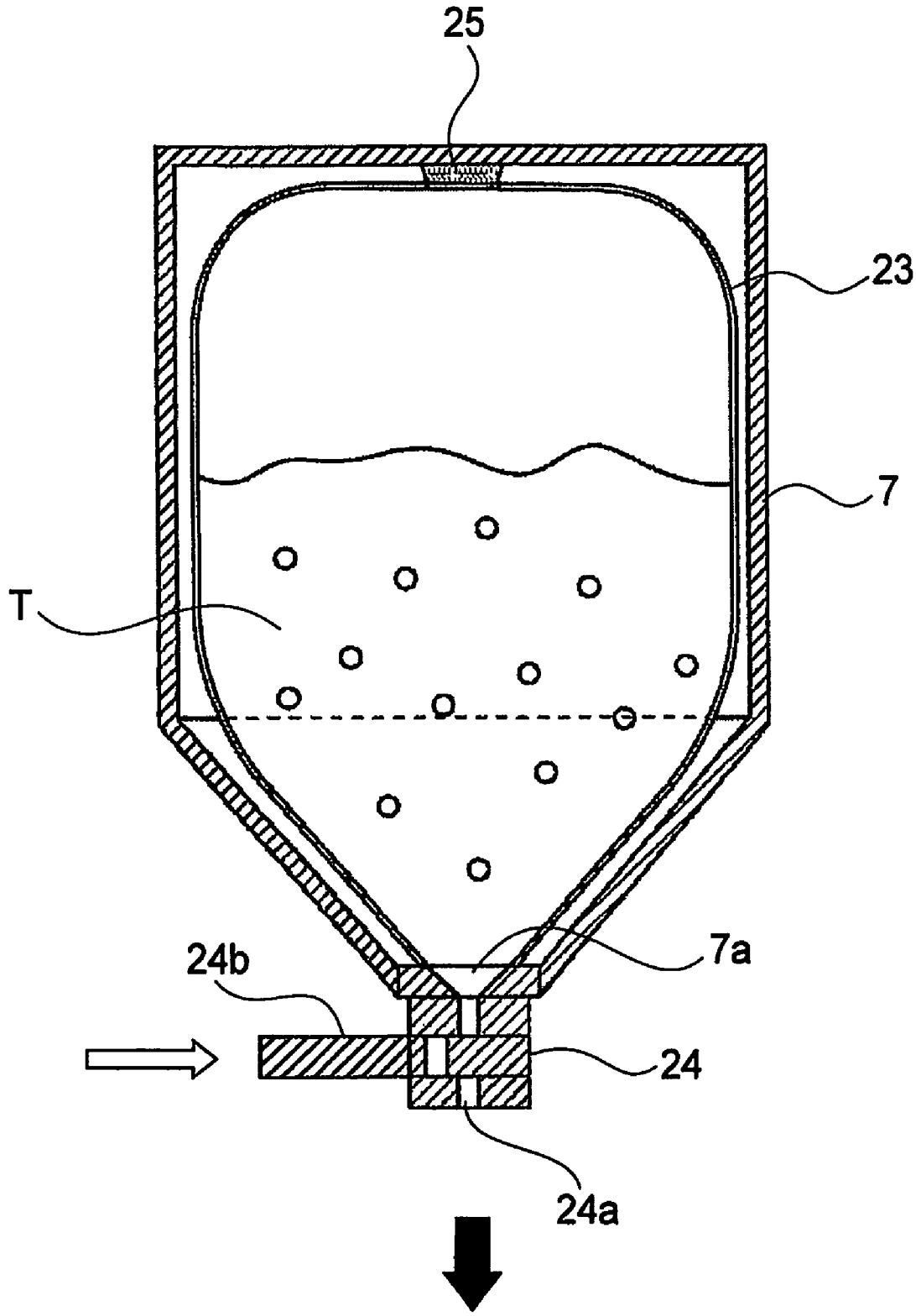
FIG. 13 is a sectional view of the developer supply container 10 according to a seventh embodiment of the present invention.

FIG. 13 is a sectional view of the developer supply container 10 in the seventh embodiment of the present invention.

The structures of the container shutter 5, sealing member 4, shutter 15, etc., in this embodiment are the same as those in the first embodiment, and therefore, will not be described.

Referring to FIG. 13, the developer supply container 10 is provided with a developer storage pouch 23 as a developer conveying means, which is disposed in the developer supply container 10, and a shutter 24, which is disposed between the outlet 7*a* and container shutter 5 employed in the first embodiment.

The developer storage pouch 23 is elastic, and is expandable by injecting air into the developer storage pouch 23. Thus, the developer storage pouch 23 is filled with developer, and compressed air as a power source, being therefore in the inflated state.

The developer storage pouch 23 is structured so that it deflates (contracts) like a balloon as the air therein is discharged. Therefore, as the developer storage pouch 23 contracts, the developer is pushed out through the outlet 7*a*.

The developer storage pouch 23 is attached to the internal surface of the top wall of the container proper 7 with the use of a small amount of adhesive 25, being thereby prevented from completely collapsing near the depletion of the developer from the developer storage pouch 23.

As the material for the developer storage pouch 23, a sheet of latex (160-170 μm in thickness), which is used as the material for balloons, surgical gloves, etc., is used.

The shutter 24 is made up of a main portion 24*a* and a shutter proper with a tab portion 24*b*. During distribution, or when the developer supply container 10 is in the normal condition, the shutter 24 is positioned so that the holes (developer passages) of the main portion 24*a* do not align with the hole (developer passage) of the shutter proper, as shown in FIG. 13.

As the tab portion 24*b* is pushed by the control portion of the apparatus main assembly 100, which is identical in function to the control portion in the first embodiment, but different in location from the control portion in the first embodiment, the developer passages of the main portion 24*a* align with the developer passage of the shutter proper with the tab portion 24*b*, allowing thereby the air in the developer storage pouch 23 to jet out to discharge the developer.

The control portion controls the discharge of the developer from the developer supply container 10, based on the developer density detected by the developer density detecting means with which the developer conveying portion 12 or developing device 201 is provided, as in the first embodiment. That is, if it is determined based on the detected developer density that the amount of the developer in the developing device 201 is insufficient, the control portion pushes the tab portion 24*b* in order to discharge the developer from the developer supply container 10.

Pressing of the switch portion 1 aligns the developer passages of the main portion 24*a* with the developer passage of the shutter proper, making it possible for the developer T to be discharged.

Then, the air in the developer storage pouch 23 is forced out along with the developer T by the resiliency of the developer storage pouch 23, through the outlet 7*a* and the developer passage in the shutter 24, into the apparatus main assembly 100.

As the developer is supplied from the developer supply container 10 to the apparatus main assembly 100, the developer storage pouch 23 deflates, like a balloon, until it becomes impossible for the developer to be discharged from the developer storage pouch 23 (developer supply container 10). The amount of the developer remaining in the developer storage pouch 23 at this point is minuscule.

Next, the method for reusing the developer supply container 10 in this embodiment will be described.

The developer supply container 10 in this embodiment is also reusable. As for the method for reusing this developer supply container 10, first, the used developer supply container 10 is recovered and is disassembled. After the disassembly, the air storage canister 2 is refilled with air through an air refilling process. The used developer storage pouch 23 is replaced with a brand-new one. The various components resulting from the disassembly of the used developer supply container 10 are reassembled into the developer supply container 10. The sealing members and the like may be replaced as necessary during the reassembly. After the developer supply container 10 is reassembled, it is filled with a predetermined amount of developer to complete the process of refurbishing the developer supply container 10.

Incidentally, in this embodiment, the developer supply container 10 was structured so that the axial line of the outlet 7*a* is parallel with the center line of the developer storage pouch 23. However, it may be structured so that the axial line of the outlet 7*a* is perpendicular to the center line of the developer storage pouch 23 as the axial line of the outlet 7*a* was perpendicular to the axial line of the switch portion 1 in the first embodiment. Such a structural arrangement is just as high in developer conveyance efficiency as the structural arrangement for the developer supply container 10 in this embodiment.

This embodiment also makes it possible to eliminate the air storage portion 2 (inclusive of nozzle portion 3 and switch portion 1), promising thereby a substantial reduction in manufacturing cost.

In the above, the present invention was described in the form of the first to seventh embodiments. However, it is needless to say that the present invention is also applicable to various modifications of the first to seventh embodiments, as long as they are agreeable with the gist of the present invention.

For example, a known conveying member such as a conveying member made up of a rotational shaft and a plurality of vanes formed of flexible resin sheet and attached to the rotational shaft, a screw, etc., may be employed as the conveying means for the developer conveying portion 12.

Further, the power source does not need to be limited to the pressure of compressed gas, and resiliency of coil springs, such as those employed in the preceding embodiments. That is, a device such as a battery, which stores electrical energy, or a spiral spring (power spring) can also be employed as the power source.

As for an example of a developer supply container equipped with a power source which generates electric power, it is also equipped with a driving member such as a conventional motor capable of converting electric power into mechanical driving force, which is used for driving a stirring-conveying member as a conveying means such as the above described developer conveying member. As the conveying means receives the driving force, the developer in the developer supply container is conveyed toward the outlet of the container, and is discharged from the container.

Among the various structural arrangements for conveying developer in a developer supply container and discharging the developer from the developer supply container, the one which employs compressed gas as a power source is preferable in consideration of reliability, simplicity, and the accuracy in the amount by which developer is discharged from the developer supply container per discharge.

In summary, according to the structural arrangements in the preceding embodiments, it is possible to substantially reduce the structural restrictions imposed upon an image forming apparatus. In other words, it is possible to afford more latitude (in relative terms) in the placement of a developer supply container in the main assembly of an image forming apparatus, affording thereby more latitude in designing an image forming apparatus. Moreover, it is possible to prevent an image forming apparatus from increasing in cost, and also, from increasing in energy demand.

INDUSTRIAL APPLICABILITY

As described hereinabove, according to the present invention, it is possible to provide a developer supply container that does not impose structural restrictions upon an image forming apparatus.

While the invention has been described with reference to the structures disclosed herein, it is not confined to the details set forth, and this application is intended to cover such modifications or changes as may come within the purposes of the improvements or the scope of the following claims.

The invention claimed is:

1. A developer supply container detachably mountable to an image forming apparatus, said developer supply container comprising:

a container body having a developer containing portion configured and positioned to contain a developer;

a discharge opening, provided in said container body, configured to permit discharging of the developer in said developer containing portion;

a gas container storing a compressed gas;

a plate-like member, disposed at a position between said container body and said gas container, and configured to move toward said discharge opening to discharge the developer in said developer containing portion through said discharge opening;

a switch portion, operable from the image forming apparatus, configured and positioned to release the compressed gas from said gas container so that said plate-like member moves toward said discharge opening; and an urging portion configured and positioned to urge said switch portion to stop the release of the compressed gas from said gas container.

2. A developer supply container according to claim 1, wherein an internal pressure of said gas container is 10-150 kPa.

* * * * *